US005331378A

United States Patent [19]

Baker et al.

[11] Patent Number: 5,331,378

[45] Date of Patent: Jul. 19, 1994

[54] TONER CARTRIDGE WITH INDEPENDENT DRIVEN SYSTEMS

[75] Inventors: Ronald W. Baker, Versailles; Robert L. Burdick, Nicholasville; Martin V. DiGirolamo, Lexington; David L. Merrifield, Lexington; James J. Molloy, Lexington; Paul D. Horrall, Lexington; Gary M. Tylicki, Georgetown; Earl D. Ward, II; Bernard L. Wilzbach, both of Lexington, all of Ky.

[73] Assignee: Lexmark International, Inc., Greenwich, Conn.

[21] Appl. No.: 99,813

[22] Filed: Jul. 29, 1993

[51] Int. Cl.[5] ..... G03G 15/00

[52] U.S. Cl. ..... 355/210; 355/245

[58] Field of Search ..... 355/200, 210, 245

[56] References Cited

U.S. PATENT DOCUMENTS

| | | | |
|---|---|---|---|
| 4,713,673 | 12/1987 | Kessoku | 344/245 X |
| 4,873,549 | 10/1989 | Tada et al. | 355/206 |
| 4,985,731 | 1/1991 | Sakakura et al. | 355/210 |
| 4,998,140 | 3/1991 | Satou et al. | 355/245 |
| 5,023,660 | 6/1991 | Ebata et al. | 355/211 |
| 5,053,817 | 10/1991 | Ogiri et al. | 355/211 |
| 5,115,281 | 5/1992 | Ohtsuka et al. | 355/319 |
| 5,126,800 | 6/1992 | Shishido et al. | 355/211 |
| 5,172,168 | 12/1992 | Satoh et al. | 355/245 |
| 5,210,573 | 5/1993 | Fukuchi et al. | 355/200 |
| 5,239,345 | 8/1993 | Kikuchi et al. | 355/245 X |

FOREIGN PATENT DOCUMENTS

| | | |
|---|---|---|
| 55-113059 | 9/1980 | Japan . |
| 63-261282 | 10/1988 | Japan . |

OTHER PUBLICATIONS

U.S. Patent Application Ser. No. 08/023,459, Filed Feb. 26, 1993 to Baker et al.

*Primary Examiner*—A. T. Grimley
*Assistant Examiner*—Nestor R. Ramirez
*Attorney, Agent, or Firm*—John A. Brady

[57] ABSTRACT

In a toner cartridge, photoconductor drum (11) is driven by a gear (3) which is in the printer, toner adder roller (48) is driven independently by a face coupling (5) which is in the printer. On the opposite side, a gear train from toner adder roller (48) drives developer roller (42) and toner paddle (52). The two systems permit the cartridge to function in different printers requiring different ratios of speeds. Stiffness requirements of the cartridge are reduced. Movements are more consistent, and space utilization is enhanced.

4 Claims, 3 Drawing Sheets

TONER CARTRIDGE WITH INDEPENDENT DRIVEN SYSTEMS

Technical Field

This invention relates to a replaceable cartridge for electrophotographic imaging containing toner, toner applicating elements and a photoconductor. Such cartridges typically have moving systems which are driven from the imaging device in which they are installed. This invention is to such a cartridge having improved moving systems.

BACKGROUND OF THE INVENTION

The internal elements of the cartridge of this invention and associated external configuration are described in U.S. patent application Ser. No. 08/023,459; filed Feb. 26, 1993, by Baker et al., assigned to the same assignee to which this application is assigned.

Typically, a replaceable toner cartridge is driven from a single gear or rotatable face coupling. U.S. Pat. No. 5,053,817 to Ogiri et al is illustrative of such a cartridge having systems driven from a gear. U.S. Pat. No. 5,023,660 to Ebata et al is illustrative of such a cartridge having systems driven by a face coupling.

With single driven systems, such a cartridge will have a constant ratio of movement with respect to all of the moving elements. Printers which differ by the ratio of movement of the photoconductor and the developer roller require different cartridges or, as shown in U.S. Pat. No. 5,126,800 to Shishido et al, different moving elements within the same cartridge, which may not be practical or efficient.

Also, when all elements are driven from the same source, power from the source must be large enough to service all the elements and that power must be translated through gears or other couplings to all of the elements. Couplings such as gears within the cartridge introduce disruptions such that the elements do not all move simultaneously at the theoretical speed, but instead exhibit jitter and some discontinuous actions.

This invention employs a cartridge in which the developing system is independently driven from the imaging device and the photoconductor roller is independently driven from the imaging device. Changing the speed ratio very effectively controls the amount of toner developed on the latent electrostatic image on the photoconductor drum.

DISCLOSURE OF THE INVENTION

The independent drive system consists of the photoconductor system and the developing system. The photoconductor frictionally drives a charge roller and a transfer roller. The developing system has a gear train on the side of the cartridge opposite the drive source linked to turn other developer members in the cartridge. Space utilization is enhanced by employing one side of the cartridge for drive terminals and the opposite side for the gear train of the developer system. Two of the rollers driven by the photoconductor are outside of the cartridge. The independent drive systems permit the cartridge to function in different apparatus requiring different ratios of speed of the photoconductor and the developer system. Lower torque inputs into the cartridge result in lower stiffness requirements for the cartridge as a whole.

BRIEF DESCRIPTION OF THE DRAWINGS

The details of this invention will be described in connection with the accompanying drawing in which.

BEST MODE FOR CARRYING OUT THE INVENTION

Figure 1:
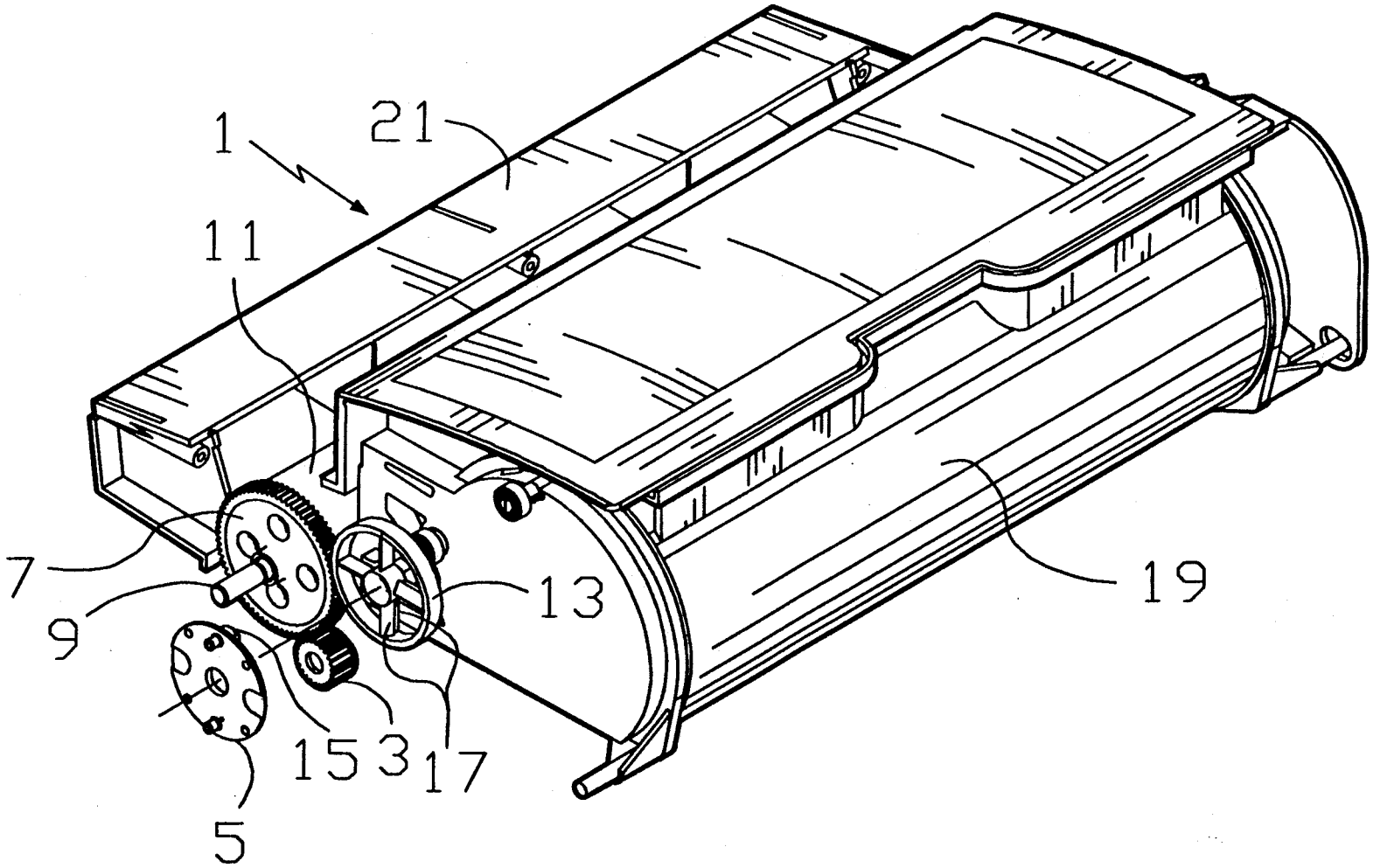
FIG. 1 is a perspective view of the cartridge from the side having the two power input couplings.

With reference to FIG. 1, the cartridge 1 is shown installed on the drive gear 3 in a printer (not shown except for couplings). Similarly, face coupling 5, a conventional Oldham coupling, is in the printer. Gear 3 meshes with gear 7 which is supported by shaft 9 and integral with photoconductor drum 11; they rotate on shaft 9. The outer extensions of shaft 9 enter slots (not shown) in the printer and thereby serve to position cartridge 1 laterally in the printer. Shaft 9 is metal and transmits electrical potential to the photoconductor drum 11 from the printer. When installed, the cartridge is opened as shown to expose the top of the photoconductor 11 for charging and optical imaging and to expose the bottom of photoconductor 11 for transfer of the developed image to paper or other substrate. Photoconductor drum 11 drives by friction two other elements (not shown) external to cartridge 1, a transfer roller to transfer image to paper and a charging roller to apply electrostatic charge to drum 11.

Gear 7 and photoconductor drum 11 are independent of coupling 5, which moves against and drives face coupling 13, through studs 15 on coupling 5 which engage spokes 17 on coupling 13. The large housing 19 which is opposite photoconductor drum 11 contains the developer system. The small, more rectangular housing 21 on the opposite side of photoconductor drum 11 is the cleaner housing 21 where toner is deposited when cleaning occurs after transfer. During imaging the photoconductive drum 11 is turned clockwise in FIG. 1 by gear 3.

Figure 2:
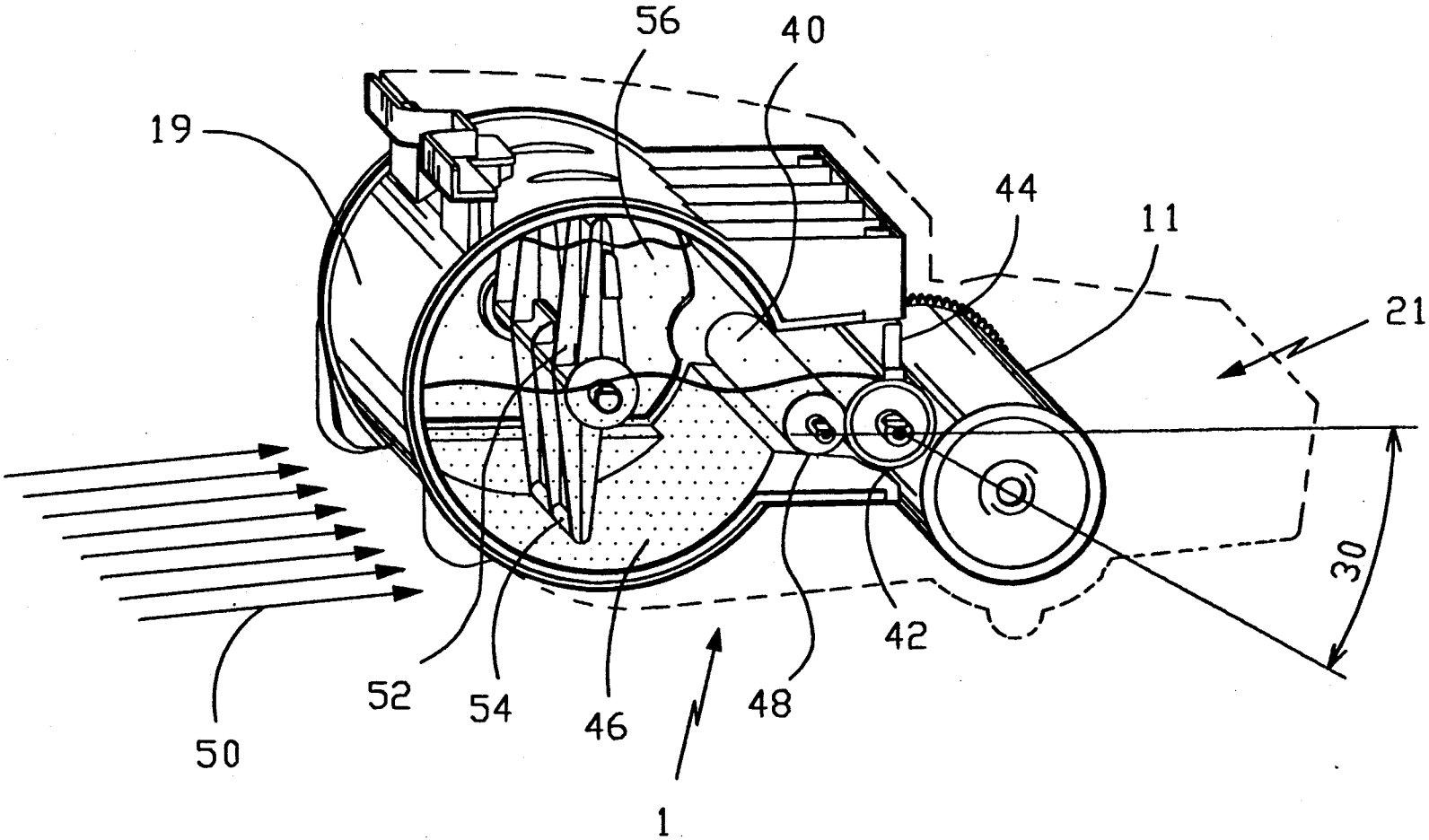
FIG. 2 is a sectional view illustrating the elements of the moving systems internal to the cartridge.

FIG. 2 illustrates the internal elements of cartridge 1, with much of the external configuration of cartridge 1 shown in dotted outline. A dry, powder toner 40 is contained in the cartridge 1, which may reach the nip of a developer roller 42 and doctor blade 44. Doctor blade 44 contacts developer roller 42 above the level of toner 40. Developer roller 42 contacts photoconductive drum 11 at an angle of 30 degrees from the horizontal. Toner chamber 46 occupies an area predominately below roller 42, and photoconductive drum 11 also is predominately below roller 42.

Toner adder roller 48 is located generally horizontal with the developer roller 42 (i.e., with its nip control at 90 degrees from the top of roller 42). With toner adder roller 48 physically between developer roller 42 and chamber 46, chamber 46 can extend downward more than twice the diameter of toner adder roller 48 as shown. Photoconductive drum 11 is located on the side of developer roller 42 opposite the location of toner adder roller 48. The bottom level of chamber 46 is determined by the toner volume requirements. The paper path 50 is under chamber 46.

During operation, paddle 52 continually moves toner in chamber 46 by blades 54 at the outer periphery of chamber 46. The developer unit housing 19 defines chamber 46 and a corresponding upper chamber 56, to form a closed chamber of chamber 46 and chamber 56 of circular configuration in which paddle 52 turns freely. The upper chamber 56 is never filled with toner 40 and exists to capture flying toner and to allow room for the paddle to rotate. The lack of toner in this region is to prevent excessive toner pressure.

In operation paddle 52 rotates in a simple circle, and is therefore a minimal source of torque fluctuations. Toner adder roller 48 and developer roller 42 are electrically charged and rotate. Doctor blade 44 is preferably a low-cost, compliant doctor blade. Doctor blade 44 is electrically charged and is not moved during operation. Used toner is collected in cleaning housing 21.

Figure 3:
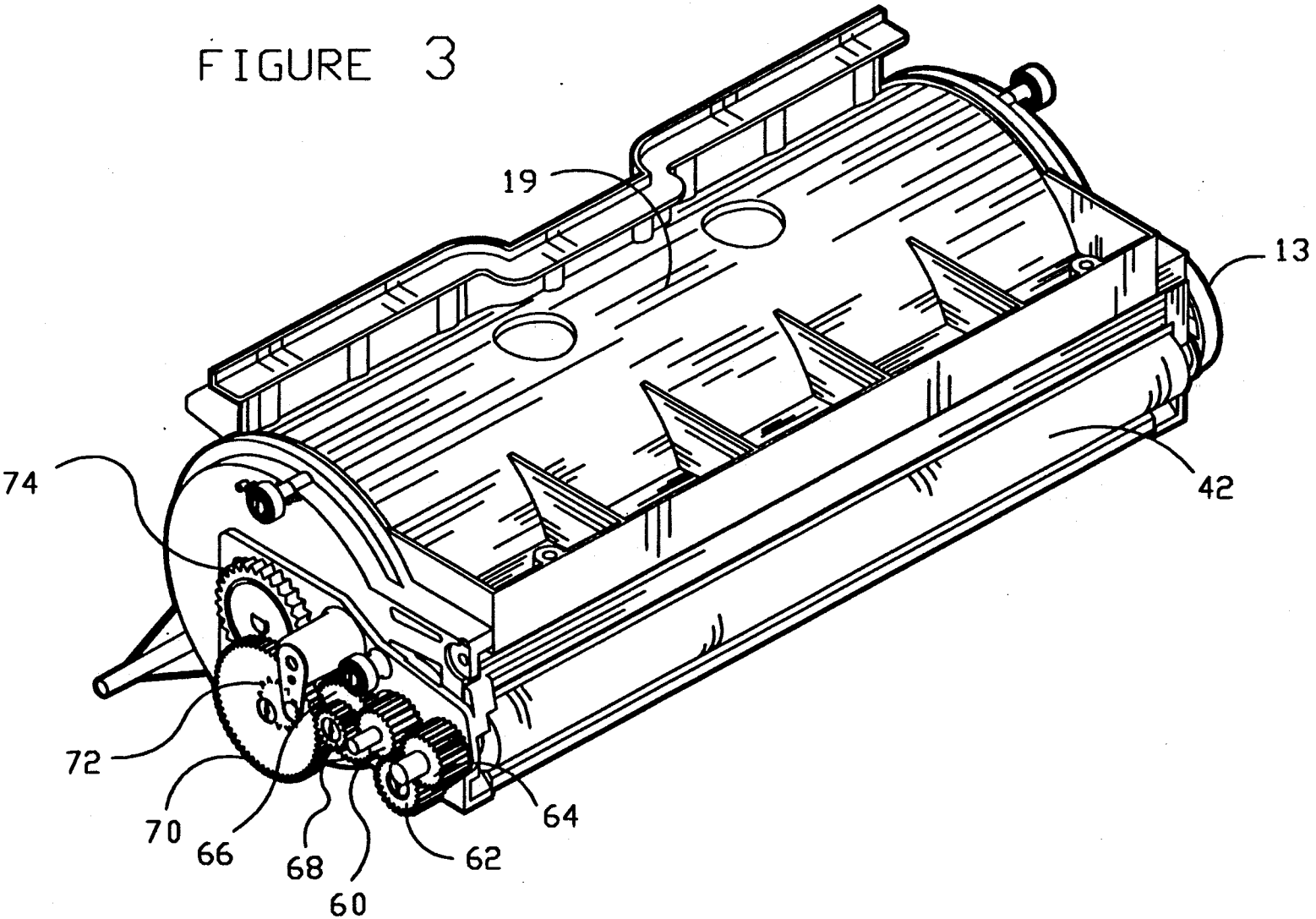
FIG. 3 is a perspective view of the cartridge from the side opposite that of FIG. 1 with the cleaning member omitted for purposes of illustration.

FIG. 3 illustrates the gear train for the developer system. Input coupling 13 is integral with toner adder roller 48. Cleaning housing 21 is omitted for purposes of illustration and therefore developer roller 42 is shown in full.

Toner adder roller 48 extends through the developer housing 19 and is integral with gear 60. Gear 60 meshes with idler gear 62, which meshes with gear 64 integral with developer roller 42. Gear 60 has 22 teeth whereas gear 64 has 24 teeth. Consequently, developer roller 42 is rotated slightly slower than roller 48 and at their nip location they move in opposite directions.

Gear 60 also meshes with gear 66, which is concentric with a smaller gear 68. Gear 68 meshes with a large gear 70 which is concentric with a smaller gear 72 (hidden and therefore shown in dotted outline) which meshes with large gear 74. Gear 74 is integral with paddle 52. Gears 66, 68, 70, 72, and 74 provide conventional speed reduction.

The foregoing configuration has no coupling within the cartridge 1, either with respect to the photoconductor drum 11 or the toner adder roller 48. Movements within the cartridge are therefore consistent. This is facilitated also by the two drive inputs being independent, so that torque to each input coupler, gear 7 for the photoconductor system and coupler 13 for the developer system, is not larger than that needed for that component of the system.

By positioning the developer system gear train of gears 60, 62, 64, 68, 70, 72 and 74 to the non-driven side of cartridge 1, space was better utilized and the components are centered.

As a separate advantage, the surface velocity ratio between the developer roller 42 and the photoconductor drum 11 is controlled independently by the speeds of drive gear 3 and face coupling 5. This allows the same cartridge 1 to meet the needs of different speed printers without any modifications.

As another separate advantage, the two torque inputs are lower than a single torque input would be, and this reduces the requirements for stiffness of the cartridge 1 as a whole, thus permitting construction of cartridge 1 with less material.

Modification within the spirit and scope of this invention can be anticipated since this invention is not dependent on the specifics shown.

What is claimed is:

1. An electrophotographic toner cartridge containing an endless, rotatable photoconductive member, a development system having at least a rotatable developer roller, a toner chamber, a rotatable toner paddle in said toner chamber, and a rotatable member intermediate said developer roller and said toner paddle, said cartridge having a first coupling for rotating said photoconductive member by coupling with a driving source from a printer and a second coupling, independent of said first coupling, for rotating said developer roller by coupling with a driving source from said printer, said first and said second couplings being on one side of said cartridge, said second coupling being an integral extension of said intermediate member, a first linkage from said intermediate member to said developer roller to rotate said developer roller by rotation of said second coupling, and a second linkage from said intermediate member to said toner paddle to rotate said toner paddle by rotation of said second coupling, said first linkage and said second linkage being entirely on the side of said cartridge opposite said one side.

2. The toner cartridge of claim 1 in which said second linkage is a speed reduction system.

3. The toner cartridge of claim 1 in which said intermediate member is a toner adder roller.

4. The toner cartridge of claim 2 in which said intermediate member is a toner adder roller.

* * * * *